US011655631B2

(12) United States Patent
Ahn et al.

(10) Patent No.: US 11,655,631 B2
(45) Date of Patent: May 23, 2023

(54) THERMAL INSULATION STRUCTURE HAVING SHEAR REBARS AND TENSION BARS INTEGRALLY FORMED IN THERMAL INSULATION UNIT

(71) Applicant: JEONGYANG SG CO., LTD., Gongju-si (KR)

(72) Inventors: Byung Kwun Ahn, Daejeon (KR); Young Jong Yoo, Hwaseong-si (KR); Sang Hee An, Daejeon (KR); Chang Geun Song, Gongju-si (KR); Jun Bum Ahn, Daejeon (KR)

( * ) Notice: Subject to any disclaimer, the term of this patent is extended or adjusted under 35 U.S.C. 154(b) by 0 days.

(21) Appl. No.: 17/354,059

(22) Filed: Jun. 22, 2021

(65) Prior Publication Data

US 2022/0002992 A1 Jan. 6, 2022

(30) Foreign Application Priority Data

Jul. 6, 2020 (KR) ..... 10-2020-0083008

(51) Int. Cl.
*E04B 1/78* (2006.01)
*E04C 5/01* (2006.01)
*E04B 1/00* (2006.01)

(52) U.S. Cl.
CPC ..... *E04B 1/78* (2013.01); *E04B 1/0038* (2013.01); *E04C 5/01* (2013.01)

(58) Field of Classification Search
CPC . E04C 5/201; E04C 5/205; E04C 5/16; E04C 5/0636; E04C 5/064; E04C 5/0645; E04C 5/06; E04C 5/0613; E04C 5/0622; E04C 5/0627; E04C 5/0631; E04C 5/01; E04C 5/03; E04B 1/78; E04B 1/80; E04B 1/003; E04B 1/0038
(Continued)

(56) References Cited

U.S. PATENT DOCUMENTS 4,959,940 A * 10/1990 Witschi ..... E04B 1/0038 52/223.13
8,733,052 B2 * 5/2014 Froehlich ..... E04B 1/0038 52/407.3

(Continued)

FOREIGN PATENT DOCUMENTS

| | | |
|---|---|---|
| KR | 10-2009-0129043 | 12/2009 |
| KR | 10-1462800 | 11/2014 |
| KR | 10-1552057 | 9/2015 |

OTHER PUBLICATIONS

English Specification of 10-1462800.
English Specification of 10-2009-0129043.
English Specification of 10-1552057.

*Primary Examiner* — Jessica L Laux

(74) *Attorney, Agent, or Firm* — Antonio Ha & U.S. Patent, LLC

(57) ABSTRACT

A thermal insulation structure comprises a thermal insulation unit provided between a floor slab and a balcony slab. Tension rebars are formed in parallel in the floor slab and the balcony slab, but are not in the thermal insulation unit. Connection tension rebars which are parallel with each other pass through the thermal insulation unit and connect the tension rebars in the floor slab and the balcony slab. Shear rebars are formed inside the thermal insulation unit to connect and support the connection tension rebars. Auxiliary shear rebars horizontally connect the shear rebars to reinforce support.

7 Claims, 6 Drawing Sheets

(58) Field of Classification Search
USPC ..... 52/405.3, 404.2
See application file for complete search history.

(56) References Cited

U.S. PATENT DOCUMENTS

| | | | | |
|---|---|---|---|---|
| 10,640,967 | B2 * | 5/2020 | Fritschi | E04C 5/073 |
| 2007/0074477 | A1 * | 4/2007 | Fritschi | E04B 1/0038 52/404.2 |
| 2014/0331581 | A1 * | 11/2014 | Larkin | E04B 1/7608 52/309.4 |

* cited by examiner (a)

(b)

THERMAL INSULATION STRUCTURE HAVING SHEAR REBARS AND TENSION BARS INTEGRALLY FORMED IN THERMAL INSULATION UNIT

CROSS-REFERENCE TO RELATED APPLICATION(S)

This application claims priority to Korean Patent Application No. 10-2020-0083008 filed in the Korean Intellectual Property Office on Jul. 6, 2020, the disclosure of which is incorporated by reference herein in its entirety.

TECHNICAL FIELD

Embodiments of the disclosure relate to thermal insulation and, more specifically, to a thermal insulation structure or insulator including connection tension rebars passing through a thermal insulation unit and connecting tension bars that are buried in a floor slab and a balcony slab and that have different thermal conductivity from the tension bars, and shear rebars provided in the thermal insulation unit to connect and support the connection tension rebars.

DISCUSSION OF RELATED ART

In general, a house is defined as a structure that includes a room and walls to separate the inside from the outside. The walls and roof of a house are usually formed of slabs made of cast concrete.

A wall of a house is formed by performing various steps, such as rebar assembly, formwork installation, concrete casting, exterior finishing, insulator attachment, and interior finishing.

Insulators are used to prevent heat transfer from the inside to outside or vice versa. Insulators are typically attached to the inside (inner walls) or outside (outer walls) of a building, and particularly, it is known that more effective insulation may be achieved when insulators are attached to the outside (outer wall) of the building.

However, a protruding structure, e.g., a veranda or balcony, of a building may cause discontinuities in the insulators on the outer wall of the building.

Discontinuities in insulation may deteriorate insulation performance.

Heat losses may occur through the discontinuities of insulators along the slabs or rebars. This phenomenon is called thermal bridging.

In building, it may thus be of significance to prevent thermal bridging. Typically, since 70% to 80% of cool or hot air leak out due to thermal bridging in cooling or heating a building, construction for preventing thermal bridging is required to save cooing/heating costs.

Further, thermal bridging may cause condensation on the inner surface of the walls, resulting in mold growth and ill health.

Further, as rebars are installed inside the protruding structure, e.g., veranda or balcony, to give reinforced support, more heat losses may occur due to the rebars which have large thermal conductivity.

In other words, the veranda or balcony may act as an air fin that accelerates heat leakage.

To address such issues, conventional methods install thermal breaks in verandas or balconies.

Korean Patent No. 10-1462800 discloses a thermal break using discontinuous rebars, and other various thermal breaks are well known.

The thermal break disclosed in Korean Patent No. 10-1462800 is briefly described below.

Referring to FIG. 6, a thermal break using discontinuous rebars includes an insulator 10, an upper tension module 20 and lower tension module 20 disposed along the width direction of the insulator 10 to resist tension in the moment direction, a compression module 30 that bears the compressive force of a slab against the vertical load of a balcony, and a truss-type inclined shear rebar 40 connecting the tension modules 20 and the compression module 30.

In the conventional thermal break, however, the truss-shaped inclined shear rebar 40 connects the inside of the wall with an external tension rebar 23 and thus still suffers from thermal bridging in which the internal heat leaks to the outside through the tension rebar 23.

Further, as the shear rebar 40 is coupled to the compression module 30 while passing through the cover of the compression module 30, the coupling between the shear rebar 40 and the compression module 30 is weak, and the compression module is small in size and fails to provide sufficient compressive force.

Although thermal break may be achieved by cutting the shear rebar 40 where the shear bar 40 and the compression module are coupled together, the coupling between the shear rebar and the compression module may weaken, resulting in poor shear force.

SUMMARY

According to an embodiment, a thermal insulation structure comprises a thermal insulation unit provided between a floor slab and a balcony slab, an upper first tension rebar and a lower first tension rebar buried in the floor slab, an upper second tension rebar and a lower second tension rebar buried in the balcony slab, an upper connection tension rebar passing through the thermal insulation unit and connecting respective opposite ends of the upper first tension rebar and the upper second tension rebar and a lower connection tension rebar passing through the thermal insulation unit and connecting respective opposite ends of the lower first tension rebar and the lower second tension rebar, shear rebars spaced apart from each other in parallel in the thermal insulation unit and connecting the upper connection tension rebar and the lower connection tension rebar, and at least one auxiliary shear rebars provided between the shear rebars and connecting the shear rebars.

The at least one auxiliary shear rebars may include at least two auxiliary shear rebars horizontally connecting the shear rebars and vertically spaced apart from each other at a predetermined interval.

The at least one auxiliary shear rebars may connect, in an inclined direction, a top of one of the shear rebars with a bottom of another of the shear rebars.

The thermal insulation structure may further comprise an upper coupling cover installed on a top surface of the thermal insulation unit and a lower coupling cover installed on a bottom surface of the thermal insulation unit, wherein a bottom surface of the upper coupling cover has a larger width than the top surface of the thermal insulation unit, and a top surface of the lower coupling cover has a larger width than the bottom surface of the thermal insulation unit, and wherein the upper coupling cover and the lower coupling cover are connected to concrete of the floor slab and the balcony slab.

Each of the upper coupling cover and the lower coupling cover may have two opposite sides that are inclined so that a width between the two opposite sides increases toward a center of the thermal insulation unit and are connected to the floor slab and the balcony slab.

Each of the upper coupling cover and the lower coupling cover may have anti-escape jaws at two opposite ends, and wherein a top and bottom of each of the anti-escape jaws are covered and supported by concrete of the floor slab and the balcony slab.

The floor slab, the balcony slab, and the thermal insulation unit may be connected together by the upper connection tension rebar and the lower connection tension rebar.

The upper and lower first tension rebars and the upper and lower second tension rebars may be formed of the same material, and the upper and lower connection tension rebars are formed of a different material from the upper and lower first tension rebars.

BRIEF DESCRIPTION OF THE DRAWINGS

A more complete appreciation of the disclosure and many of the attendant aspects thereof will be readily obtained as the same becomes better understood by reference to the following detailed description when considered in connection with the accompanying drawings, wherein.

DETAILED DESCRIPTION

Hereinafter, preferred embodiments of the disclosure are described with reference to the accompanying drawings to be easily practiced by one of ordinary skill in the art.

Figure 1:
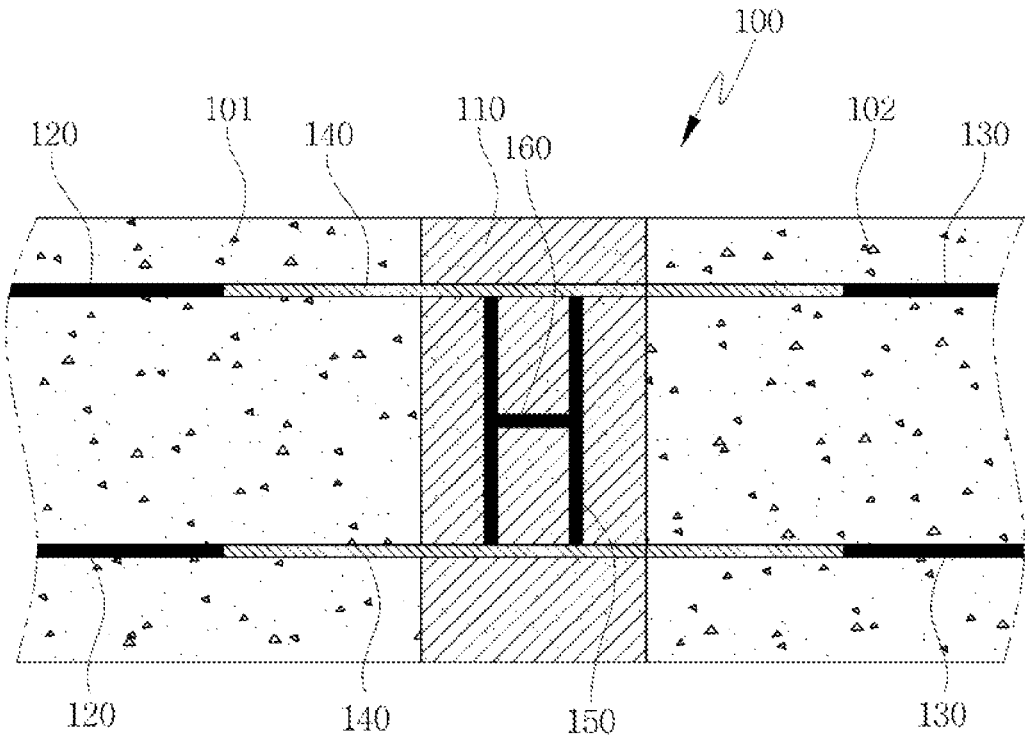
FIG. 1 is a cross-sectional view illustrating a thermal insulation structure according to an embodiment.
Figure 2:
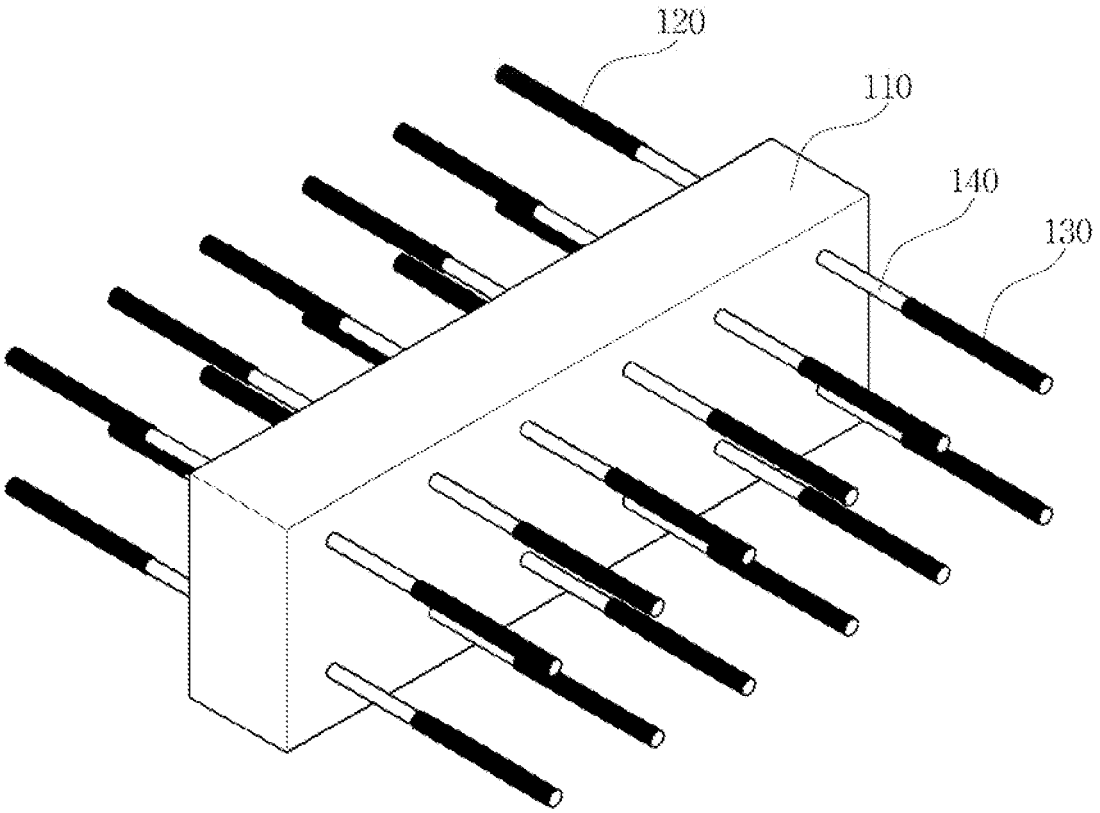
FIG. 2 is a perspective view illustrating a thermal insulation structure according to an embodiment.
Figure 3:
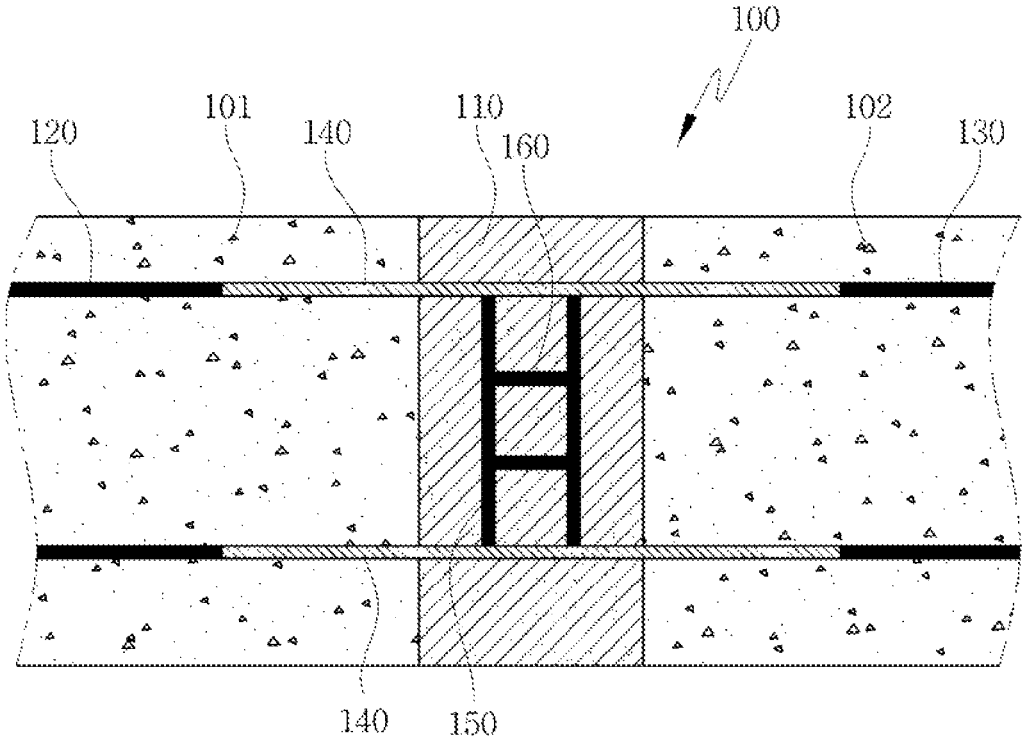
FIG. 3 is a cross-sectional view illustrating a thermal insulation structure further including auxiliary shear rebars in a thermal insulation unit according to an embodiment.
Figure 4:
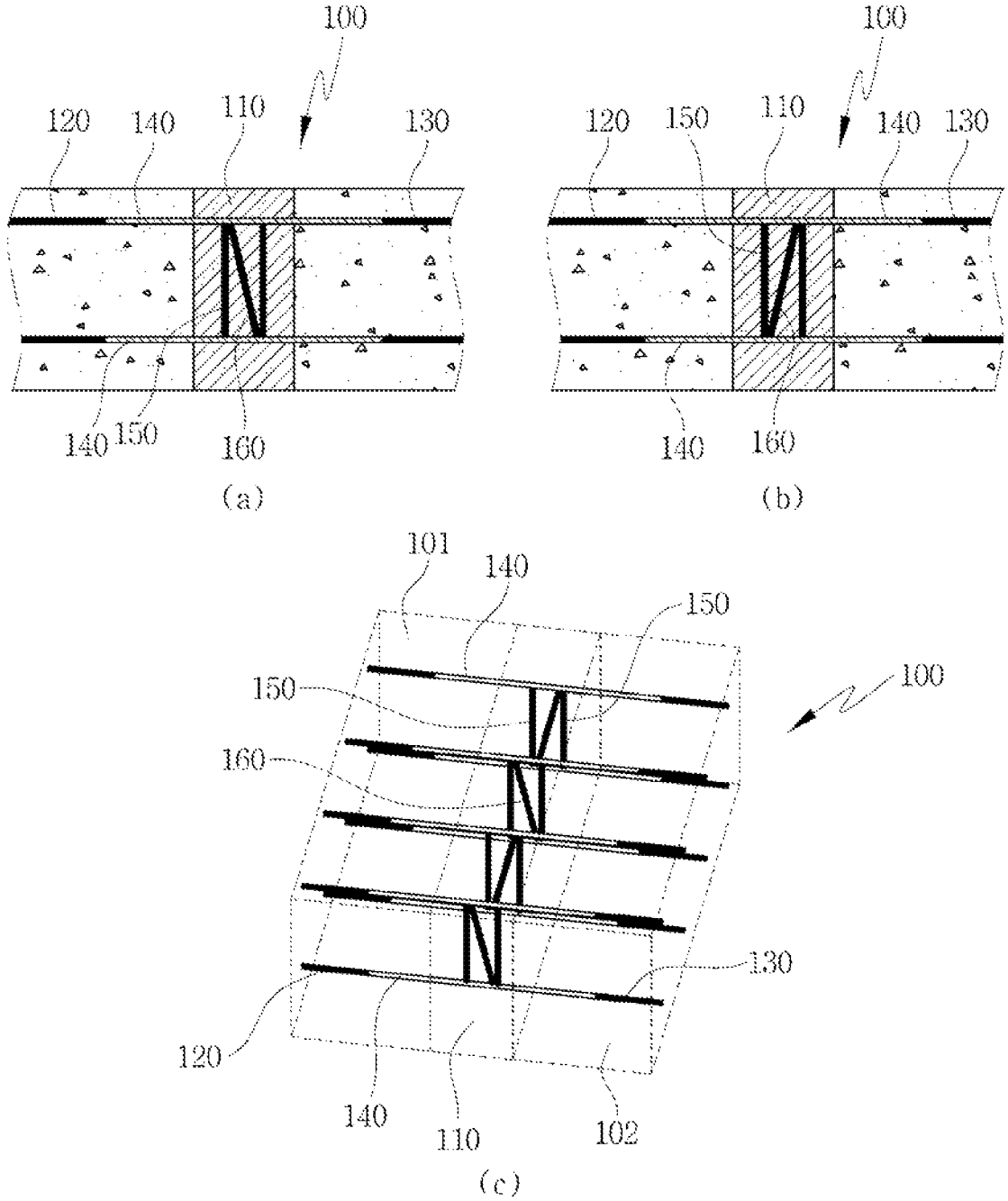
FIG. 4 illustrates an example in which a thermal insulation structure includes N-shaped, or inverted N-shaped combinations of shear rebars and auxiliary shear rebars in a thermal insulation unit according to an embodiment.
Figure 5:
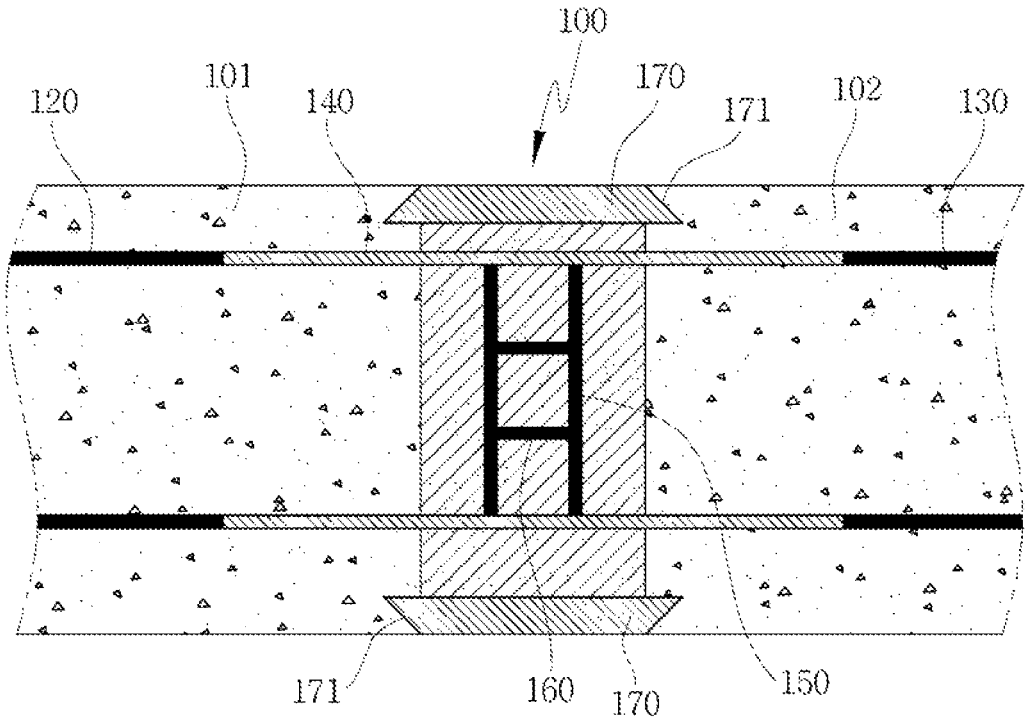
FIG. 5 illustrates a thermal insulation structure further including coupling covers according to an embodiment.
Figure 5:
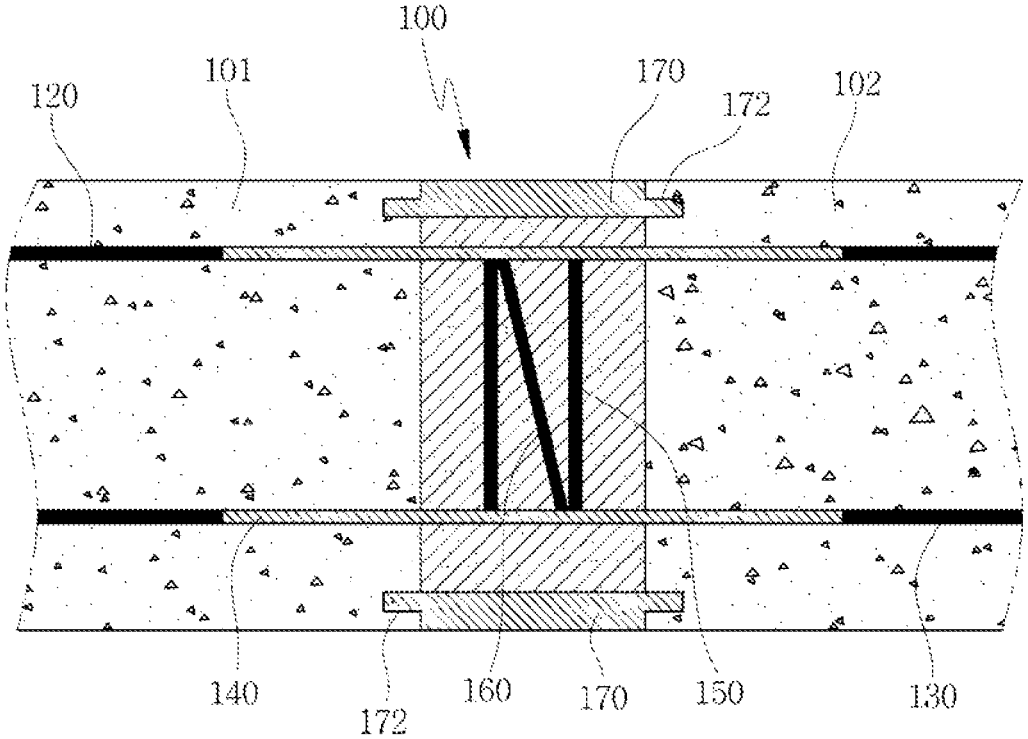
Figure 6:
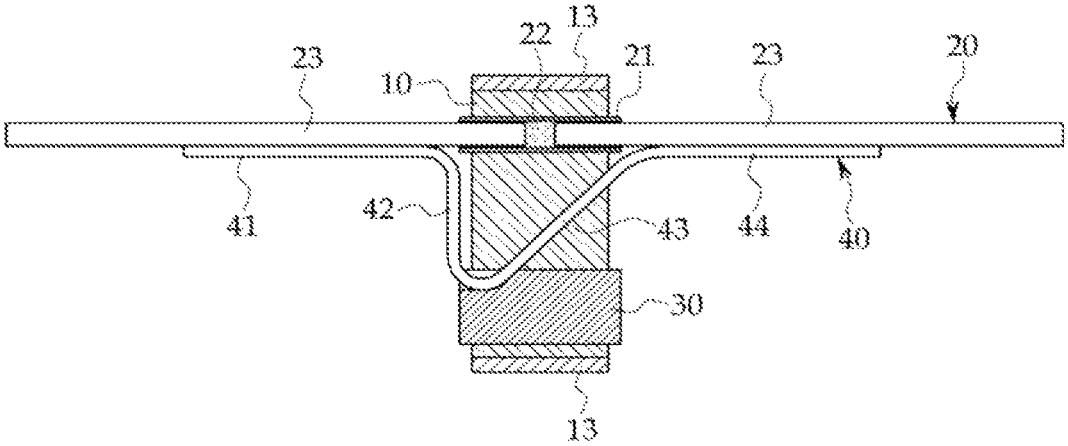
FIG. 6 is a cross-sectional view illustrating a thermal break according to the prior art.

FIG. 1 is a cross-sectional view illustrating a thermal insulation structure according to an embodiment. FIG. 2 is a perspective view illustrating a thermal insulation structure according to an embodiment. FIG. 3 is a cross-sectional view illustrating a thermal insulation structure further including auxiliary shear rebars in a thermal insulation unit according to an embodiment. FIG. 4 illustrates an example in which a thermal insulation structure includes N-shaped, or inverted N-shaped combinations of shear rebars and auxiliary shear rebars in a thermal insulation unit according to an embodiment. FIG. 5 illustrates a thermal insulation structure further including coupling covers according to an embodiment.

Referring to FIGS. 1 to 4, a thermal insulation structure 100 includes a thermal insulation unit 110 provided between a floor slab 101 and a balcony slab 102, an upper first tension rebar and a lower first tension rebar buried in the floor slab 101, an upper second tension rebar and a lower second tension rebar buried in the balcony slab 102, an upper connection tension rebar passing through the thermal insulation unit 110 and connecting respective opposite ends of the upper first tension rebar and the upper second tension rebar and a lower connection tension rebar passing through the thermal insulation unit 110 and connecting respective opposite ends of the lower first tension rebar and the lower second tension rebar; shear rebars 150 spaced apart from each other in parallel in the thermal insulation unit 110 and connecting the upper connection tension rebar and the lower connection tension rebar, and at least one auxiliary shear rebars 160 provided between the shear rebars 150 and connecting the shear rebars 150.

Referring to FIGS. 1 to 5, the floor slab 101 and the balcony slab 102 are horizontally connected with the thermal insulation unit 110 via connection tension rebars 140. Upper and lower connection tension rebars 140 pass through the thermal insulation unit 110, which is an insulator, and the floor slab 101 and balcony slab 102, which are formed of concrete. By the configuration, there are no other heat transfer elements than the connection tension rebars 140 connected from the floor slab 101 through the thermal insulation unit 110 to the balcony slab 102, so that the thermal bridge breaking effect may be very high. The plurality of shear rebars 150 installed inside the thermal insulation unit 110 may provide sufficient stability even without other separate shear rebars.

Typically, an apartment in an apartment building is composed of wall slabs (not shown) and a floor slab (e.g., the floor slab 101) to divide floors. The balcony slab 102 is connected to the floor slab 101 and projects outward of the wall slab.

The balcony or veranda sticking out the wall may act as a kind of air fin to cause heat dissipation). The heat from the floor slab 101 may be abruptly transferred to the balcony slab 102, causing drastic heat (or coldness) losses to the outside.

Rebars for connecting the floor slab 101 and the balcony slab 102 may be buried and installed in the floor slab 101 and the balcony slab 102 to provide reinforced support to the balcony slab 102, in which case such heat losses may be accelerated through the rebars which have high heat conductivity.

According to an embodiment, thermal breaks are installed in the slabs of a building to prevent heat (or coldness) losses to the outside. According to an embodiment, the thermal insulation unit 110 is installed at the junction between the floor slab 101 and the balcony slab 102 to break or prevent thermal bridging.

Thus, the floor slab 101 and the balcony slab 102 may be prevented from thermal bridging while remaining connected to each other by the thermal insulation unit 110. However, such a mere structure may weaken connection between the floor slab 101 and the balcony slab 102.

To make up for such weakness and provide reinforced support, upper and lower first tension rebars 120 are installed inside the floor slab 101, upper and lower second tension rebars 130 are installed inside the balcony slab 102, and upper connection tension rebars 140 are installed to pass through the thermal insulation unit 110 to connect the respective opposite ends of the upper first tension rebars 120 and the upper second tension rebars 130 and lower connection tension rebars 140 are installed to pass through the thermal insulation unit 110 to connect the respective opposite ends of the lower first tension rebars 120 and the lower second tension rebars 130 to thereby reinforce connection between the floor slab 101 and the balcony slab 102. Further, the upper and lower connection tension rebars 140 have much lower thermal conductivity than the first tension rebars 120 and the second tension rebars 130 and are vertically welded together, thus decreasing the heat conductance or transfer from the first tension rebars 120 to the second tension rebars 130 and hence preventing or reducing thermal bridges.

However, this structure may be relatively weak in shear force as compared with when the first tension rebars 120 and the second tension rebars 130 are directly connected and may be insufficient in ensuring support and shear force between the floor slab 101 and the balcony slab 102.

Rebars (reinforcing bars) are buried in the balcony slab 102 and the floor slab 101, and the thermal insulation unit 110 is connected to the floor slab 101 and the balcony slab 102, between the floor slab 101 and the balcony slab 102. The upper and lower connection tension rebars 140 are formed to pass through the thermal insulation unit 110, but the tension rebars 120 and 130 do not pass through the thermal insulation unit 110. The tension rebars 120 and 130 are connected to the connection tension rebars 140. The connection tension rebars 140 have significantly low thermal conductivity as compared with the tension rebars 120 and 130. By the structure, thermal bridging which cause heat loss or leakage to the outside may be prevented.

The shear rebars 150 may be installed inside the thermal insulation unit 110 to vertically connect the upper and lower connection tension rebars 140 to increase support and shear force.

The auxiliary shear rebars 160 may be provided to connect the shear rebars 150 by welding to further reinforce support and shear force.

Two or more auxiliary shear rebars 160 may be horizontally installed one over another, at predetermined intervals, between the shear rebars 150 to further reinforce support or shear force as shown in FIG. 3.

As the shear rebars 150 and the auxiliary shear rebars 160 are integrally formed by welding inside the thermal insulation unit 110, and the shear rebars 150 are welded to the upper and lower connection tension rebars 140 inside the thermal insulation unit 110, the upper and lower connection tension rebars 140 may remain constant in interval and position and withstand compressive stress. Thus, even without any separate support for withstanding compressive stress, and the upper and lower connection tension rebars 140 may be prevented from buckling and have enhanced structural stability.

Referring to FIG. 4, the auxiliary shear rebars 160 may be formed to connect the top end of one shear rebar 150 and the bottom end of the other shear rebar 150, thus allowing them to overall look like the letter "N" or inverted N. The shear rebars 150 and auxiliary shear rebars 160, although installed only in the thermal insulation unit 110, may provide sufficient support and stability. Thus, easy and quick installation or construction is possible.

According to an embodiment, the first tension rebars 120 and the second tension rebars 130 may be formed of the same material, and the first tension rebars 120 and the second tension rebars 130 may be formed of a different material from the connection tension rebars 140, thus simultaneously enhancing thermal bridging breaking effects and stability. For example, the first tension rebars 120 and the second tension rebars 130 may be formed of rebars (made of regular steel), and the connection tension rebars 140, the shear rebars 150, and the auxiliary shear rebars 160 may be formed of stainless steel. However, the shear rebars 150 and the auxiliary shear rebars 160 may also be formed of rebars (made of regular steel) even in which case the thermal bridge breaking effect may be maintained.

As such, according to an embodiment, in the thermal insulation structure 100, in which the shear rebars 150 are buried inside the thermal insulation unit 110, and the shear rebars 150 are integrally formed with the connection tension rebars 140, the connection tension rebars 140, which have significantly low thermal conductivity as compared with rebars, are formed to pass through the thermal insulation unit 110 and connected to the rebars provided in the slabs, thereby preventing or reducing thermal bridging, and the shear rebars 150 are vertically provided in parallel with each other to connect the upper and lower connection tension rebars 140, thereby reinforcing shear force. Further, the auxiliary shear rebars 160 are provided horizontally to connect the shear rebars 150*s*, thereby further reinforcing shear force.

According to an embodiment, the thermal insulation structure 100, in which the shear rebars 150 are provided inside the thermal insulation unit 110 and the shear rebars 150 are integrally formed with the connection tension rebars 140, may further include an upper coupling cover 170 and a lower coupling cover 170 coupled to the top and bottom, respectively, of the thermal insulation unit 110 installed at the junction between the floor slab 101 and the balcony slab 102, as illustrated in FIG. 5. The thermal insulation unit 110 may be formed of an insulator, e.g., expanded polystyrene (EPS).

The coupling covers 170 are installed on the top and bottom of the thermal insulation unit 110 to delay or block the upward or downward spread or transfer of flames or high temperatures of the thermal insulation unit 110, e.g., when a building fire occurs. The coupling covers 170 may be formed of lightweight concrete. The coupling covers 170 may be connected to the concrete of the floor slab 101 and the balcony slab 102. The top surface of the upper coupling cover 170 may be coplanar or flush with the top surfaces of the floor slab 101 and the balcony slab 102, and the bottom surface of the lower coupling cover 170 may be coplanar or flush with the bottom surfaces of the floor slab 101 and the balcony slab 102 as illustrated in FIG. 5. The top surface of the upper coupling cover 170 may be substantially identical in width to the top surface of the thermal insulation unit 110, and the bottom surface of the upper coupling cover 170 may be larger in width than the top surface of the thermal insulation unit 110. The bottom surface of the lower coupling cover 170 may be substantially identical in width to the bottom surface of the thermal insulation unit 110, and the top surface of the lower coupling cover 170 may be larger in width than the bottom surface of the thermal insulation material.

Thus, the coupling covers 170 are supported by the concrete of the floor slab 101 and the balcony slab 102 and may thus be prevented from escaping off.

Each of the coupling covers 170 have two opposite sides 171 that are inclined so that the distance thereof increases toward the inside of the floor slab 101 and the balcony slab 102. The inclined surfaces 171 may prevent the coupling covers 170 from escaping off the floor slab 101 and the balcony slab 102 in case of fire, thus stopping or delaying spread of flames. The thermal insulation unit 110 has excellent thermal insulation performance but may be vulnerable to fire, so that if the coupling covers 170 are removed, flames may spread very quickly.

Referring to FIG. 5(*b*), two opposite ends of each coupling cover 170 may have anti-escape jaws 172 positioned inside the floor slab 101 and the balcony slab 102 to prevent the coupling cover 170 from escaping off.

Thus, the thermal insulation structure 100, in which the shear rebars 150 are provided in the thermal insulation unit 110, and the shear rebars 150 and the connection tension rebars 140 are integrally formed, may at least partially stop or delay flame spread by the coupling covers 170 provided in the thermal insulation unit 110.

According to the embodiments of the disclosure, by the configuration described above, heat loss that may be caused by the first and second tension rebars may be prevented by the connection tension rebars which have different thermal conductivity from the first and second tension rebars. Thus, thermal bridging or heat losses may be effectively prevented or reduced.

Further, as the upper and lower connection tension rebars are connected by the shear rebars vertically positioned between the upper and lower connection tension rebars, deformation or buckling due to compression stress may be prevented, and allowable spreading factor for the slabs may be increased.

The coupling covers are formed on the top and bottom of the thermal insulation unit, and the coupling covers have inclined side surfaces or anti-escape jaws which are connected to, or buried or covered by the concrete of the floor slab and the balcony slab so that the coupling covers may be prevented from escaping off in case of fire while preventing spread of flames.

The auxiliary shear rebars are provided between the shear rebars, which are formed vertically and in parallel with each other, to connect the shear rebars horizontally or inclinedly, thereby providing enhanced shear force and support.

In the thermal insulation structure, the tension rebars and shear rebars are integrally formed, with the shear rebars excluded from the heat pathway, thereby increasing thermal insulation.

The upper and lower connection tension rebars are connected and supported by the vertical shear rebars in the thermal insulation unit, thus remaining constant in interval and position while withstanding compression stress. Thus, the upper and lower connection tension rebars may be prevented from buckling even without a separate supporting structure. As such, the thermal insulation structure may have enhanced structural stability.

Although the disclosure is shown and described with reference to embodiments thereof, it would be appreciated by one of ordinary skill in the art that various changes or modifications may be made thereto without departing from the scope of the disclosure defined by the claims.

What is claimed is:

1. A thermal insulation structure, comprising:

a thermal insulation unit provided between a floor slab and a balcony slab;

an upper first tension rebar and a lower first tension rebar buried in the floor slab;

an upper second tension rebar and a lower second tension rebar buried in the balcony slab;

an upper connection tension rebar passing through the thermal insulation unit and connecting respective opposite ends of the upper first tension rebar and the upper second tension rebar and a lower connection tension rebar passing through the thermal insulation unit and connecting respective opposite ends of the lower first tension rebar and the lower second tension rebar;

shear rebars spaced apart from each other in parallel in the thermal insulation unit and connecting the upper connection tension rebar and the lower connection tension rebar; and at least one auxiliary shear rebars provided between the shear rebars and connecting the shear rebars; and an upper coupling cover installed on a top surface of the thermal insulation unit and a lower coupling cover installed on a bottom surface of the thermal insulation unit, wherein a bottom surface of the upper coupling cover has a larger width than the top surface of the thermal insulation unit, and a top surface of the lower coupling cover has a larger width than the bottom surface of the thermal insulation unit, and wherein the upper coupling cover and the lower coupling cover are connected to concrete of the floor slab and the balcony slab.

2. The thermal insulation structure of claim 1, wherein the at least one auxiliary shear rebars includes at least two auxiliary shear rebars horizontally connecting the shear rebars and vertically spaced apart from each other at a predetermined interval.

3. The thermal insulation structure of claim 1, wherein the at least one auxiliary shear rebars connects, in an inclined direction, a top of one of the shear rebars with a bottom of another of the shear rebars.

4. The thermal insulation structure of claim 1, wherein each of the upper coupling cover and the lower coupling cover has two opposite sides that are inclined so that a width between the two opposite sides increases toward a center of the thermal insulation unit and are connected to the floor slab and the balcony slab.

5. The thermal insulation structure of claim 1, wherein each of the upper coupling cover and the lower coupling cover has anti-escape jaws at two opposite ends, and wherein a top and bottom of each of the anti-escape jaws are covered and supported by concrete of the floor slab and the balcony slab.

6. The thermal insulation structure of claim 1, wherein the floor slab, the balcony slab, and the thermal insulation unit are connected together by the upper connection tension rebar and the lower connection tension rebar.

7. The thermal insulation structure of claim 1, wherein the upper and lower first tension rebars and the upper and lower second tension rebars are formed of the same material, and the upper and lower connection tension rebars are formed of a different material from the upper and lower first tension rebars.

* * * * *